US005197313A

United States Patent [19]

Chandler et al.

[11] Patent Number: 5,197,313

[45] Date of Patent: Mar. 30, 1993

[54] LEVER-ACTUATED COMBINATION LOCKING APPARATUS

[75] Inventors: Roy L. Chandler, Arlington, Tex.; Richard P. McCullough, 1410 Rankin, Ashdown, Ark. 71822

[73] Assignee: Richard P. McCullough, Ashdown, Ark.

[21] Appl. No.: 473,536

[22] Filed: Feb. 1, 1990

[51] Int. Cl.[5] ..... E05B 37/16

[52] U.S. Cl. ..... 70/288; 70/304; 70/312

[58] Field of Search ..... 70/287, 288, 301, 304, 70/312

[56] References Cited

U.S. PATENT DOCUMENTS

| | | | |
|---|---|---|---|
| 478,873 | 12/1889 | Lawrence | 70/304 |
| 1,345,020 | 6/1920 | Naslund | 70/287 X |
| 1,408,434 | 3/1922 | Bauers | 70/304 |
| 1,556,687 | 10/1925 | Haynes | 70/304 |
| 1,600,050 | 9/1926 | Kessler | 70/312 |
| 2,121,060 | 6/1938 | Tibbetts | 70/312 |
| 2,160,698 | 5/1939 | Herbst | 70/312 X |
| 2,591,165 | 4/1952 | Krasnansky et al. | 70/288 X |
| 3,087,765 | 4/1963 | Chapman | 70/287 X |
| 4,176,533 | 12/1979 | Nordendale | 70/288 X |
| 4,524,592 | 6/1985 | Saitoh | 70/287 |

FOREIGN PATENT DOCUMENTS

| | | | |
|---|---|---|---|
| 49433 | 3/1939 | France | 70/312 |
| 121448 | 8/1945 | Sweden | 70/287 |

*Primary Examiner*—Gary L. Smith

*Assistant Examiner*—Suzanne L. Dino

*Attorney, Agent, or Firm*—Charles W. McHugh

[57] ABSTRACT

A locking apparatus that includes first and second structural elements that are adapted to be juxtaposed and positioned next to one another in a "locked" mode, and physically separated from one another when "unlocked." When in its locked mode, the locking apparatus is restrained against separation until a manual force is simultaneously applied to appropriate levers, ends of which are accessible on the exterior of the apparatus.

A plurality of levers are mounted on the first of the two structural elements for rocking movement about a pivotal axis carried by the first element. Each lever has a first end that protrudes externally of the apparatus, and a second end that is sized and shaped so that it may be engaged with a lip surrounding an associated aperture in the second structural element. A biasing device is provided for continuously biasing each of the levers to a centered rest position, where at least one of the levers will be in an overlapping or interfering position with respect to the adjacent lip of its associated aperture. In a preferred embodiment, there are two configurations for the locking levers; one is normally engaged and the other disengaged when they are in their centered rest positions. Knowing the correct combination to open the locking apparatus involves knowing which levers must be moved and which direction they must be moved. Removing finger pressure from the exposed ends of the levers allows the levers to automatically return to their centered positions.

25 Claims, 3 Drawing Sheets

LEVER-ACTUATED COMBINATION LOCKING APPARATUS

BACKGROUND OF THE INVENTION

This invention relates generally to locking devices that operate like a combination lock—without the insertion of a separable key; more specifically, it relates to an apparatus in which certain permanently contained levers are moved to predetermined positions in order to open the apparatus. A distinguishing characteristic of the preferred embodiment of the apparatus is that is is always biased to a locking position and can never be accidentally left in an unlocked condition.

There are many situations in which there is a desire to have some structure secured against movement (i.e., locked) without requiring that there be some type of key that is insertable into a recess for the purpose of effecting release of the locking device. As a class, such keyless devices may generally be found in the following U.S. patents: U.S. Pat. No. 612,335 to Haggstrom entitled "Permutation Lock"; U.S. Pat. No. 1,556,687 to Haynes entitled "Lock"; U.S. Pat. No. 3,087,765 to Chapman entitled "Medicine Cabinet Latch"; U.S. Pat. No. 4,176,533 to Nordendale entitled "Wall Safe Lock"; and U.S. Pat. No. 4,524,592 to Saitoh entitled "Combination Lock." Of these patents, perhaps the closest ones to the concept to be described herein are U.S. Pat. Nos. 3,087,765 to Chapman and 4,524,592 to Saitoh. The Chapman latch is appealing because it offers the possibility of permitting ready access to the interior of a container like a medicine cabinet to all persons who are informed of the correct combination, while denying access to children or other persons who should properly be excluded from the cabinet. And there are many "real life" situations that are analogous to the medicine cabinet example. And even if common sense did not dictate that certain persons be excluded from a certain thing or secured area, we now find that there are legislative bodies that have decided to pass laws that impose criminal penalities upon those who fail to keep weapons such as firemans out of reach of children. The State of Florida is one example of a state that has recently chosen to establish criminal penalties for adults who leave firearms where they can easily be picked up and used (or misused) by minors.

While a resident of Florida would now have even more interest in keeping a firearm secured against access by unauthorized persons, those people who have a legitimate need or desire to keep firearms readily available would probably not immediately jump at the opportunity to use a traditional lock and key for controlling access to a gun case or the like. For example, if a homeowner has been frequently subjected to attempts at nighttime burglary, he or she probably would not want to have to search in the middle of the night for a key in order to open a case where a gun is being stored. Similarly, the manager of a service station may want to secure the keys to a wrecker or service truck in such a way that employees can easily obtain access to the vehicle keys without requiring that they first find the only key to a security box. By using a combination-type lock, employees need only be informed of the combination in order to have access to whatever things are secured in a locked box.

While the idea of providing a keyless or combination lock is not new, most of the previously known combination locks have been characterized by requiring the proper positioning or alignment of certain rings, dials, or levers, all of which have indicia on them. To be able to open such locks, a person must first be able to see the indicia—which automatically eliminates a considerable number of blind and sight-impaired people. And even if a person can see well in normal daylight, there might not be enough ambient light in a dark room to permit a person to read the numerals on a dial or see the letters on a pad of push-buttons. There has remained a need, therefore, for a device that is capable of being easily opened by a blind person, or a person who wants to open a secure container without the benefit of seeing indicia on one or more dials, etc. It is an object of this invention to provide such a locking apparatus.

Another object is to provide a locking apparatus of the combination type in which the combination may be changed by any person who has the ability to gain access to the interior of the apparatus, and who the minimal mechanical ability to temporarily remove a couple of fasteners and relocate one or more levers.

A further object is to provide a lock that is easy to open but which is compact, economical and versatile enough to be attached to a variety of containers including boxes, trunks, cabinets, cases, trays, cabinets, and drawers, to provide dependable security for the contents of such containers. This is true whether the container is expected to routinely hold medicines or toxic cleaning agents, firearms or jewelry, vehicle keys or private correspondence and financial records, etc.

These and other objects will be apparent from a reading of the specification and the attached claims, with appropriate reference to the attached figures of the drawing.

BRIEF DESCRIPTION OF THE INVENTION

Figure 1:
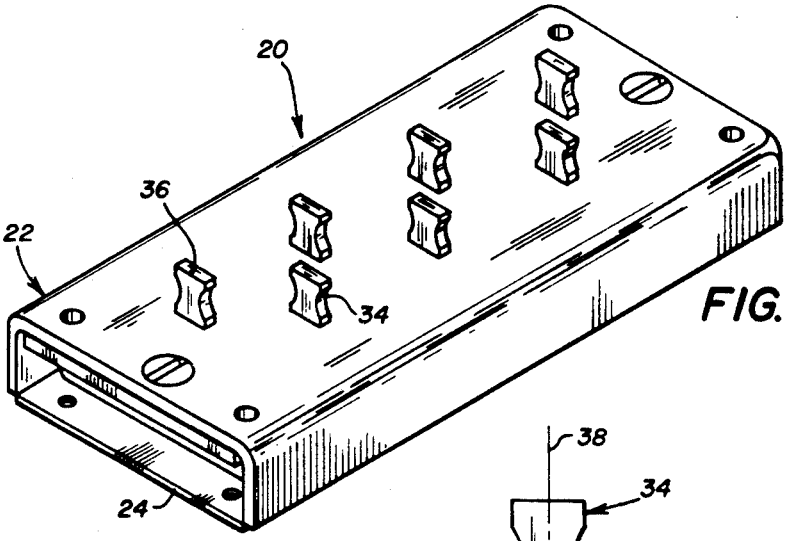
FIG. 1 is a perspective view of a locking apparatus is accordance with this invention, shown in an assembled condition and with its two primary structural elements juxtaposed and engaged with one another.

In brief, the invention comprises a locking apparatus that includes first and second structural elements that are adapted to be juxtaposed and positioned next to one another in a "locked" mode, and physically separated from one another when "unlocked." When in its locked mode, the locking apparatus is restrained against separation until an external force is applied to one or more appropriate levers that are accessible on the exterior of the apparatus.

A plurality of levers are mounted on the first of the two structural elements for rocking movement about a pivotal axis carried by the first element. Each of the levers has a first end that protrudes externally of the apparatus, and each first end is configured so as to be readily manipulable by one of a person's fingers. Each lever also has a second end that is sized and shaped so that it may bear against (i.e., be engaged with) a lip surrounding an associated aperture in the second structural element. A biasing means is provided for continuously biasing each of the levers to a rest position. In their respective rest positions, at least one of the plurality of levers will be in an overlapping or interfering position with respect to the adjacent lip of its associated aperture. When in this position, such a lever may be aptly described as being "engaged " with the lip around its associated aperture, even through manufacturing tolerances may dictate that there be some slight clearance between a lever and its adjacent lip. In other words, an overlapping relationship will prevent separation of a lever and an "engaged" lip, if someone should attempt to separate them without first moving the appropriate levers in accordance with the private code for a particular lock. And when at least one of the levers is so engaged, the two structural elements are blocked against separation. So when one or more of its levers is positioned so as to overlap the lip of an adjacent aperture, the locking apparatus as a whole may be described as being in its locked mode.

In a preferred embodiment, thre are two configurations for the locking levers. One of the locking levers has a generally L-shaped protuberance at its second (or interior) end, such that the lever may be described as analogous to a hook-shaped element. The longitudinal portion of the "hook" is significantly removed form the longitudinal axis of the lever, and the transverse portion of the hook extends inwardly toward the longitudinal axis of the lever. It is the transverse portion of the hook that is designed to be engaged with its associated lip when the lever is in its rest position. A modest force must be applied by one of a person's fingers in order to move such a lever to an unlatched or open position, in order that the two structural elements might be separated.

The other lever configuration has two confronting "hooks," both of which face inwardly toward the longitudinal axis of the lever. Each of these confronting hooks may be considered to be a mirror image of the other. Such a lever is intended to be disengaged or unlatched when the lever is biased to its rest position. But if an unauthorized person attempts to surreptitiously open the locking apparatus and moves such a lever away from its rest position, in either direction, the lever will be moved into an engaged or locking position. A preferred locking apparatus will include a mixture of some levers that are never engaged or latched (unless they are improperly moved away from their rest positions), and some other levers that are always latched until they are moved away from their rest positions. Knowing the correct combination to open the locking apparatus therefore involves knowing which levers must be moved and which direction they must be moved—in order to place all of the concealed hooks so that they will pass unobstructed through their associated apertures.

A typical locking apparatus may have seven levers that are spaced sufficiently close together that they may be grasped by the fingers of one hand. Three of the seven levers may be of the normally engaged or latched configuration, and the other four will therefore be of the normally unlatched configuration. While the number of possible combinations for such a seven-lever locking apparatus will be 2187, only the three engaged levers need be moved in order to unlatch the apparatus and permit it to be opened.

Another advantage of the locking apparatus is that it is not necessary that someone be able to see any indicia that are printed on the levers in order to correctly manipulate those levers that must be moved. Because all of the levers are automatically biased to their respective rest positions when they are left alone, a person will find a locking apparatus in the same condition every time that it is approached. Therefore, a blind person could unlock the apparatus merely by ascertaining the orientation of the apparatus, turning it if necessary in order to orient it in a certain way, and then finding those levers that he or she knows must be manipulated in order to unlock the apparatus. Similarly, a seeing person with reasonable tactile ability in his or her fingers could unlock the apparatus in total darkness. Such a locking apparatus could be particularly useful in providing security for things that might need to be obtained when light is minimal or even unavailable.

DETAILED DESCRIPTION OF A PREFERRED EMBODIMENT OF THE INVENTION

Referring initially to FIG. 1, a locking apparatus 20 is shown in its locked mode, wherein first and second structural elements 22, 24 are juxtaposed and positioned next to one another. When in its unlocked or open mode, the first structural element 22 may be separated from the second structural element 24. In one example, the two elements 22, 24 are rigidly connected to a box-like container having an open-top and a lid that pivots to close the container; bringing the structural elements together and securing them will inherently hold together the container parts that are to be secured. If the container is a gun case having a lid that is designed to be rotated to an open position, affixing the first structural element 22 to the lid and the second structural element 24 to the bottom portion of the gun case will automatically hold the gun case closed when the locking apparatus is engaged. Unlocking the apparatus 20 will then permit separation of the first and second elements 22, 24 and simultaneously open the gun case. Of course, parts of the first structural element 22 must be accessible on the outside of the gun case, so that certain parts may be selectively manipulated by a person's fingers. The second structural element 24 will naturally be mounted interiorly of the locking apparatus, which will be inside the gun case where it is concealed from view when the apparatus is locked.

Figure 2:
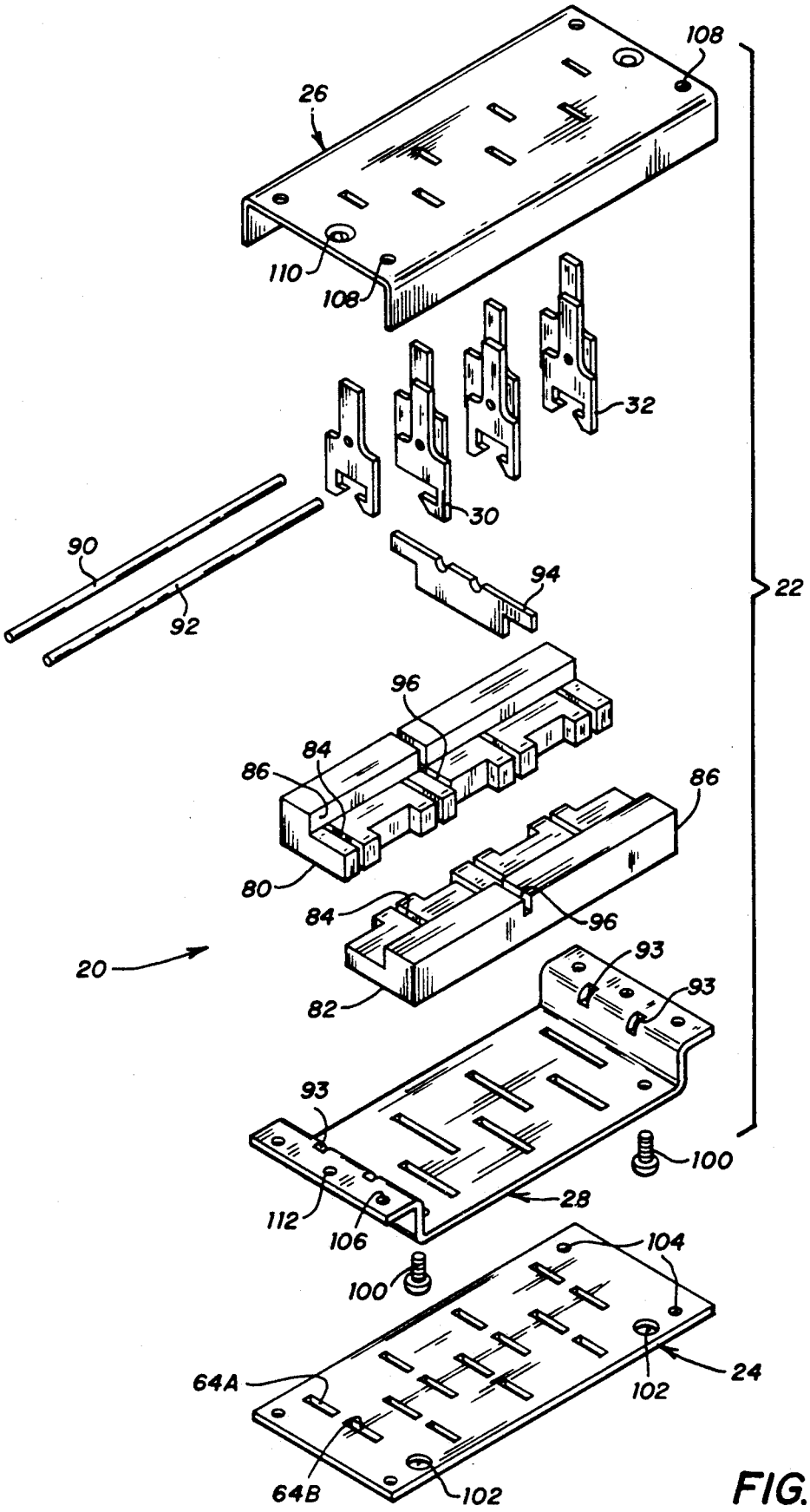
FIG. 2 is another perspective view of the apparatus, but this time showing the components in an "exploded" condition, in order to illustrate the relative positions of the significant pieces.

To foster economy in manufacture as well as contributing to an overall light weight, the first structural element 22 is preferably assembled from two pieces of sheet metal (i.e., thin steel) 26, 28, which will be more fully described hereinafter. The "exploded" FIG. 2 shows the relative placement of these elements 22, 24 before they are brought together in an assembled condition.

Figure 3:
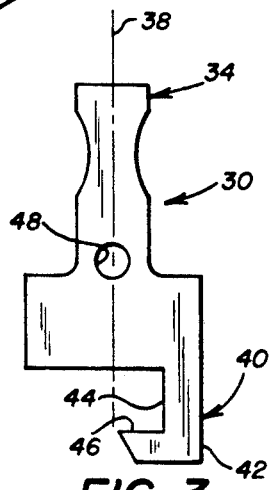
FIG. 3 is a front elevational view, drawn at a different scale, of one of the two types of levers or "keys" that are preferred for the apparatus, said levers being manually moved in accordance with a unique combination for each particular locking apparatus in order to place it in an open or unlocked condition.
Figure 4:
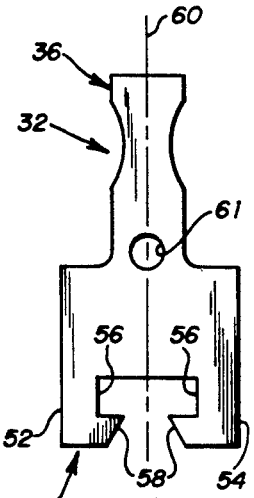
FIG. 4 is a front elevational view, similar to FIG. 3, showing another type of lever that is useful with the apparatus, this second lever being configured so that it is normally in a neutral or unlocked condition, but which is capable of being moved to a locked condition if an unauthorized person begins to tamper with the apparatus by randomly moving levers.

Referring additionally to FIGS. 3 and 4, a plurality of levers 30, 32 are mounted on the first structural element 22 for rocking movement with respect to said element. Exposed on the outside of the structural element 22 are the first ends of the levers 30, 32. Each of the first ends 34, 36 is configured in such a way as to be easily manipulable by a person's fingers. A preferred configuration for a first end includes a pair of concave portions that are symmetrically arranged about the lever's longitudinal axis 38. The levers also have second ends, which are concealed within the apparatus 20 so that they are not visible when the apparatus is locked. In order that a person will not be able to identify a lever's internal configuration by looking at its exposed portion, the first ends 34, 36 of both kinds of levers should be identical.

The second end 40 of the first lever 30 has a generally L-shaped protuberance 42 made up of a longitudinal piece 44 and a transverse piece 46. The longitudinal piece 44 extends downwardly in a pendant fashion (as seen in the drawing) in a direction that is generally parallel to the longitudinal axis of the lever. Parallelism with the axis 38 is convenient from a manufacturing standpoint but is not critical to its operation; it is important, however, that the longitudinal piece 44 be spaced from the axis by a significant distance. The significant separation distance is part of an overall design concept that puts the "bearing" portions of the levers as close as possible to a plane that passes through the fulcrum point of a given lever. The fulcrum point or pivot axis for a lever is established, of course, by the aperture 48, which is about midway between the two ends 34, 40. The transverse piece 46 extends from the distal end of the piece 44 inwardly toward the longitudinal axis 38, and it is this transverse piece that is designed to be "engaged" with the second structural element 24 when the lever is in its rest position.

Because of its appearance, the second end 40 of a lever may be thought of as the equivalent of a claw or hook that is functional for grabbing or holding things. The second end 40 may be expected to someday experience some potentially significant loads, if someone should attempt to defeat the locking apparatus by attempting to pry it apart with a screwdriver or the like. So while the levers 30, 32 do not normally experience much loading, they should be made strong enough to resist improper efforts to defeat the locking apparatus. To this end, the levers are preferably made of a material such as sheet metal or a high-strength plastic; steel having a thickness of about 0.08 inch will be suitable for many locks, but thicker steel would obviously provide greater strength. Additional resistance against tampering is obtained by turning the "hook" inwardly (toward the longitudinal axis 38) rather than outwardly, in order that the point of contact between the transverse piece 46 and its mating structure will be as close as possible to the longitudinal axis 38. This makes it possible to accommodate substantial holding loads in a direction almost coincident with the longitudinal axis of a lever without concurrently introducing any transverse forces that might tend to tilt or rock the lever toward an unlocked position.

Turning attention next to FIG. 4, the second lever 32 has a first end 36 which is configured exactly like the first end of lever 30. Its second end 50 has two depending members 52, 54, each of which has a longitudinal piece 56 and an inwardly turned transverse piece 58. The two depending members 52, 54 are equally sized and shaped, and each may be considered to be a mirror image of the other. They are also equally spaced from the longitudinal axis 60 of the lever 32, so that they will experience equal movements about their axis of rotation (the center of aperture 61) when finger pressure is applied to either side of the first end 36 in a transverse direction. The two transverse pieces 58 are shorter than the corresponding transverse piece 46 of lever 30, with the result that the tips of the pieces 46 are further away from the longitudinal axis 60—and there is more clearance to permit upward movement of the lever 32 with respect to second structural element 24, at an appropriate time.

The extra distance between the tips of the pieces 46 is provided because lever 32 is intended to be biased to a neutral position wherein it is centered between the two ends of the excursion path of first end 36. That is, lever 32 is expected to be biased so that it is normally upright and essentially perpendicular to the top of element 22 when there is no external force applied to the first end 36. In this position there will be no interference between the transverse pieces 58 and a narrow structure that lies on the longitudinal axis 60. The structural element 22 can therefore be pulled straight up and away from structural element 24 without causing the lever 32 to engage any part of element 24. On the other hand, if a lever 32 is ever pushed sideways, its second end will move to where one of the transverse pieces 58 will cause interference against withdrawal of the element 22, and the entire apparatus 20 should be considered as locked because one of its levers is engaged.

Figure 5:
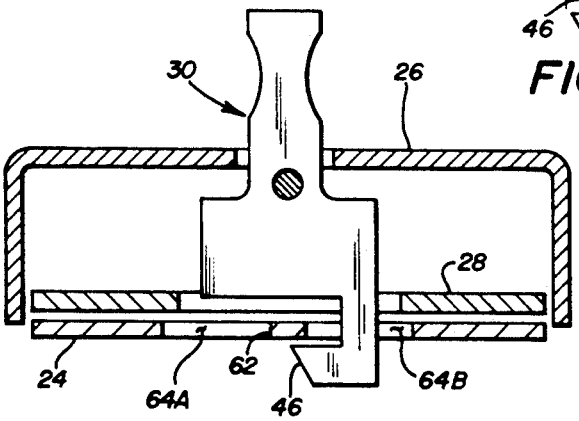
FIG. 5 is a fragmentary view, in elevation, of a lever as shown in FIG 3 in association with certain structural parts of the apparatus, and the lever being shown in its rest position—which is a position that would render the apparatus locked, irrespectively of the positions of the other levers.

With continuing reference to FIG. 2, and additional reference to FIG. 5, one of the "no go" or normally engaged levers 30 is shown in its rest position, wherein the transverse piece 46 lies directly underneath a structural part of element 24. In the preferred embodiment, this structural part 62 essentially divides an aperture in element 24 into two halves; for convenience, the two halves will be referred to as apertures 64A and 64B. A study of FIG. 5 will make it clear that any effort to pull lever 30 upward will cause the piece 46 to bear against the transverse lip 62 that is adjacent aperture 64B. Of course, the lever 30 could also be installed in the apparatus 20 so that the L-shaped protuberance 42 is on the left side of the figure instead of the right side. Either way, the transverse piece 46 will be "engaged" with the structural segment 62 until some external forces is applied to the first end 34 in order to rock the lever 30 about its axis of rotation.

Figure 6:
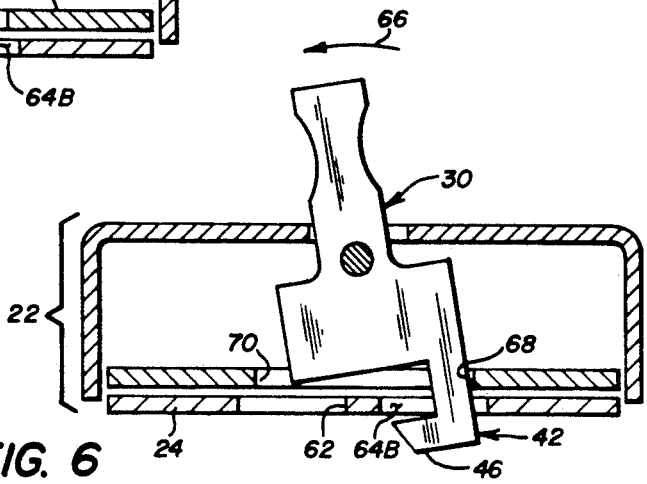
FIG. 6 is a fragmentary view similar to FIG. 5 but showing the lever rotated temporarily to an unlatched position with respect to an apertured plate that is below it.

Referring additionally to FIG. 6, the lever 30 is shown in a temporary position that it will occupy as long as a transverse force is applied in a direction represented by arrow 66. It will be seen in FIG. 6 that the second end 42 is now in a position to move upward through aperture 64B, such that the elements 22 and 24 might be separated. Also worthy of mention with respect to this figure is the edge of structural piece 28—against which the lever 30 is pressing. This edge, identified by the reference numeral 68, serves as a mechanical stop for lever 30. And all of the levers preferably have such a mechanical stop against which they bear when an appropriate degree of rocking movement has been accomplished. The reason for having such mechanical stops 68 is to promote uniformity in the "feel" that a person experiences when the levers 30, 32 are moved away from their rest positions. The goal is to preclude any sort of a sensation that may be realized by a person who is surreptitiously trying to open the apparatus 20 and attempting to sense when a particular lever has been moved to an unlocked position. Perhaps it should also be mentioned in reference to FIG. 6 that moving a lever 30 in a direction opposite to arrow 66 will serve no purpose other than to increase the amount of interference that would be realized if a person should try to lift transverse piece 46 vertically with respect to static lip 62. In the absence of an improper attempt at separation, there will be no physical contact between piece 46 and lip 62 as a result of tilting the lever, because of the significant distance between the piece 46 and the lever's axis of rotation. And incorrect movement of lever 30 will eventually be halted by mechanical stop 70, which lies on the other side of axis 38 by a distance equal to the distance between the axis and stop 68.

Figure 7:
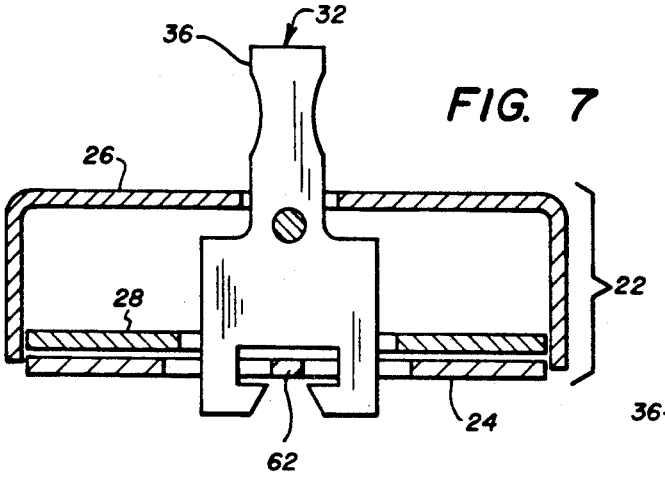
FIG. 7 is a fragmentary view, in elevation, of a lever as shown in FIG. 4 in association with certain structural parts of the apparatus, and the lever being shown in its rest position—which is a position that renders the apparatus unlatched, provided that all of the other levers are also in an unlatched state.
Figure 8:
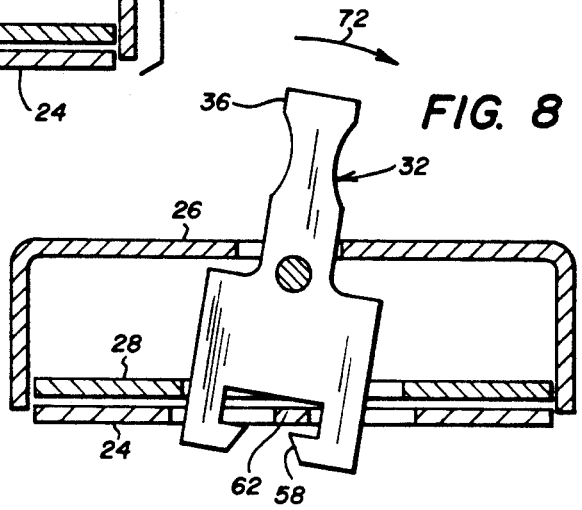
FIG. 8 is a fragmentary view similar to FIG. 7 but showing the lever rotated to a position that would render the apparatus locked, irrespective of the positions of the remainder of the levers.

Referring next to FIG. 7, an exemplary "go" lever 32 is shown in its rest position. It will be clear that lifting structural element 22 vertically would be possible as long as the pair of hooks at the bottom of lever 32 remained centered with respect to static lip 62. Depending upon the condition of the rest of the levers, the apparatus could then be described as unlatched. Referring additionally to FIG. 8, any rocking movement of lever 32 about its axis of rotation caused by a force in the direction of arrow 72 will move the right-hand hook (i.e., piece 58) into an interference condition with respect to lip 62. Hence, a person who simply tries to guess which lever to move and which direction in which to move it has a high probability of pushing on a normally "go" lever and moving it to a locked position.

Referring once again to FIG. 2, a simple but very dependable means is provided for biasing each of the levers 30, 32 to a rest position, said means preferably being in the form of a pair of complementary blocks 80, 82 of resilient material such as polyurethane foam. A preferred polyurethane material will have a Shore hardness of 70 Durometer. The two blocks 80, 82 are sized and shaped so that they will fit vertically within the space between top part 26 and bottom part 28 of the first structural member 22, and longitudinally between the two upturned ends of bottom part 28. Block 80 has four transverse slots 84 that are sized and positioned to receive the four levers that are shown as being positioned along the back of the locking apparatus 20. Resilient block 82 has three slots 84 that are sized and positioned to receive the three levers that are mounted along the front of the locking apparatus. The widths of the slots 84 are sufficient to provide ample clearance alongside the levers 30, 32, so that there will be no dragging force that might tend to restrain the levers against returning to their neutral position. Each of the blocks 80, 82 has an elevated portion 86 that serves to resist displacement of each lever 30, 32 and to restore the levers to their respective rest positions after any displacement force is removed. By establishing the center of a given lever's excursion path as its rest position, the basic shape of the blocks 80, 82 may be almost the same, except that one block will have four slots 84 and the other will have three (in this particular seven-lever example).

One reason for wanting an irregular shape and/or an irregular number of levers 30, 32 is to facilitate identification of the orientation of a locking apparatus 20 by feel alone. That is, it is desirable that a person be able to touch the top of a locking apparatus and then establish which is the front and which is the back without having to rely on touching the container to which the locking apparatus is attached. By providing two rows of levers and providing a different number of levers in each row, and also offsetting the position of the levers so that the first lever in one row is spaced inwardly from the first lever in the other row, a person need only touch the first levers of two rows in order to determine which will be the shorter row. By feeling which row is shorter, a person can then quickly orient the locking mechanism in any direction that he or she finds appropriate in order to push the required levers to their unlocked positions.

It should be understood, therefore, that arranging the levers in two (or more) rows is not critical to the operation of the levers, per se. But it is true that placing seven levers, for example, in two rows makes a more compact grouping and therefore makes it easier for a single hand to reach whichever levers must be rocked. It is also advantageous to place the levers on two parallel rows, and to select at least one lever in each row that must be rocked inwardly in order to place the locking apparatus 20 in an unlatched condition. In effect, applying inwardly directed forces on two or three spaced levers will have the effect of applying a simultaneous squeezing force on those levers, such that the top part of the locking apparatus will be effectively grasped by the same action that is unlatching the levers. Without changing the squeezing action by the fingers of one hand, the two major parts of an apparatus 22, 24 may be physically separated. This is in contrast to the latching arrangement with many doors, locks, catches, etc., wherein a first hand must be applied to whatever latch is present and then another hand must be placed on a handle or the like to pull the latch apart. Because a single hand can both unlock the apparatus 20 and separate it into two parts without changing position, the apparatus may be aptly described as a one-hand locking apparatus. The opening action can also be facilitated by providing a spring that aids in pushing the elements 22, 24 apart just as soon as the appropriate levers have been moved to an unlatched condition.

Figure 9:
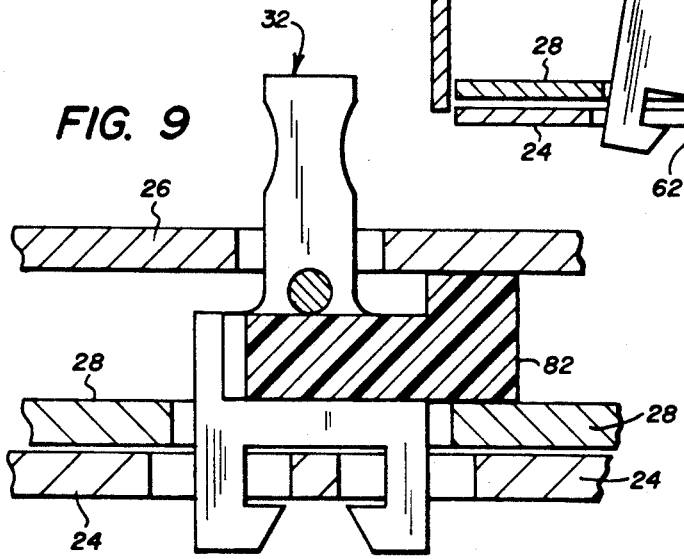
FIG. 9 is a fragmentary, elevational view showing the spatial position of a preferred form of biasing means that automatically restores the levers to a zero or neutral position when they are released.
Figure 10:
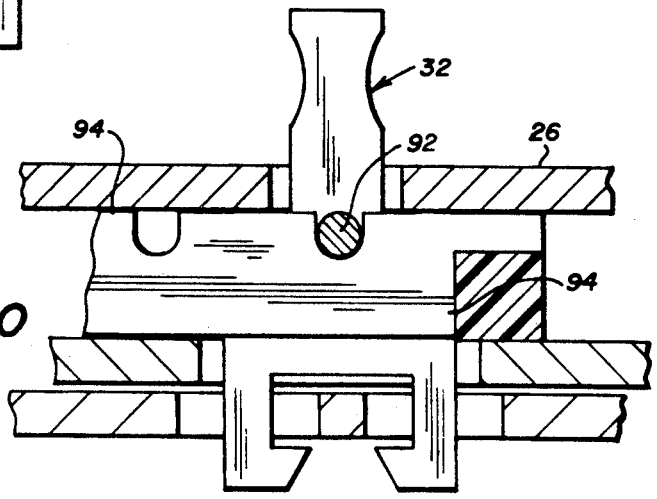
FIG. 10 is fragmentary, elevational view of a mid-span brace that helps hold the fulcrum rods for the multiple levers in the apparatus.

An advantageous manner of placing the levers at the appropriate locations and supporting them is to mount them on two parallel rods 90, 92 that may be easily slipped into spaced notches 94 formed in opposite ends of bottom piece 28. The rods 90, 92 are sized to provide a slip fit in the apertures 48, 62 of the respective levers 30, 32. The rods also have a diameter that will provide essentially negligible clearance underneath the top piece 26, so that the rods are prevented from moving upward by piece 26. No special indexing or meticulous alignment of the individual levers 30, 32 is required, because the resilient blocks 80, 82 serve as side-to-side spacers for the levers, as well as biasing members to center the levers in their neutral positions. To provide additional support for the rods 90, 92, a rigid brace 94 may be inserted at a convenient place between the two ends of structural case 22. Appropriate slots 96 are provided in the resilient blocks 80, 82 to receive and hold such an interior brace 94. FIGS. 9 and 10, which are cross-sectional views taken through two closely spaced and parallel planes, show the relative placement of these various components.

Also visible in FIG. 2 are a pair of cap screws 100 that are rigidly mounted to the bottom piece 28. These cap screws preferably have tapered heads so that they may readily engage and become centered with corresponding apertures 102 as the two pieces are brought together. Other apertures 104 are provided in structural element 24, so that it may be secured with rivets or the like to some structure like the bottom half of a gun case. By forming the element 24 from sheet metal, the several apertures can be punched and the element can be shaped with readily available metal-working equipment, at a very modest cost. Four other apertures 106 are provided in the structural piece 28 and four similarly placed apertures 108 are provided in the structural piece 26. Rivets or other fasteners may be passed through the aligned apertures 106, 108 in order to secure structural element 22 to the lid of a gun case or the like. Two other sets of apertures 110, 112 (on element 26 and element 28, respectively), provide an opportunity to maintain the pieces 26, 28 together, so that they may be handled as a unit-prior to the time that they are fixed to the container that is to be secured. Because they will normally be handled as a unit prior to installation, the pieces 26, 28 are referred to herein, for convenience, as structural element 22.

While rivets or equivalent permanent fasteners may be advantageously used in connecting structural element 22 to a movable lid or the like, it may be desirable to use removable fasteners to pass through the aligned apertures 110, 112. If removable fasteners are used in these apertures, it will be possible for the owner of the locking apparatus to disassemble the apparatus at will and change the pattern of levers, i.e., the "combination," by repositioning one or more of the levers. For example, by first unlocking the apparatus and then opening what amounts to a case 22 and lifting rod 90 out of its nested position, and then switching places between, say, a "no go" lever 30 and a "go" lever 32, the old locking apparatus will have a new "combination" or set of lever positions that will cause the apparatus to be changed from locked to unlocked. The second element 24 need not be changed in any way, because its plurality of apertures are all uniformly arranged on the flat plate, and the apertures 64A, 64B are completely neutral as to what kind of lever is associated with them. So if an employer ever experienced any change in those employees who should have knowledge of the combination for a particular lock, a new combination could be established in a short period of time—with only a small screwdriver and without requiring the services of a skilled locksmith. And keys, tools, computer access codes or any other thing needing physical security could be protected against unauthorized access by persons who no longer have a need to use them.

While the preferred technique for biasing the levers to a central, rest position is a resilient body like urethane blocks 80, 82, other biasing devices such as mechanical springs are also known to provide similar results when properly used. However, coil springs and the like would require some structure to confine them so that they always remain in alignment with their associated levers. Hence, resilient bodies like the polyurethane blocks constitute the preferred means for restoring levers to a correct position after each use.

Another advantage of the apparatus 20 is that the levers are automatically self-centering, so that they always return to a neutral position as soon as finger pressure on the levers is relieved. Therefore, an observer who happens to approach an opened box can never look at the lever positions in order to discover which levers were moved in order to open the lock. This is in marked contrast to some other forms of combination locks, e.g., push-button locks, in which the correct combination can be discovered by simply seeing which buttons are depressed in an open lock. Such locks always remain in their open position until someone physically changes at least one of the buttons, dials or levers in order to conceal the combination from a casual observer. Of course, persons concerned with security can always deliver lectures on never leaving a combination lock in such a way that its "secret" can be revealed to a casual observer; but it seems more dependable to simply build into a lock some means for automatically hiding its combination immediately after it has been opened.

With regard to the number of levers that are selected for a particular lock, the space that is available on the container to be secured and the degree of security that is desired will likely affect the choices that are made. If each lever has three positions, the number of possible combinations (T) is given by the formula $T=3^n$, where n is the number of levers. With seven levers, there are 2187 possible combinations in a three-position lock. But of course it is not necessary that a lock designer decide that all of the levers must be simultaneously moved in order to open the lock. By using two different kinds of levers, some of which are inherently in a "go" mode and others which require movement in order to get out of their "no go" mode, a designer can still have substantial versatility in designing a given lock without creating an economic burden in manufacturing and storing a wide variety of unique parts. That is, by reducing the shapes of levers that must be kept in inventory to one or two, and achieving a wide variety of lock combinations by making various choices in lever placement and orientation, a significant standardization of parts can be realized and manufacturing economies can be obtained.

While only the preferred embodiment of the invention has been disclosed herein in great detail, it should be apparent to those skilled in the art that modifications could be made without departing from the spirit of the invention. For example, the pieces 26, 28 could be molded from high strength plastics instead of being stamped from sheet metal. And certainly more or fewer levers could be used in a design, depending upon the degree of security that is desired and the speed with which a particular lock is to opened. Obviously, the more levers that must be identified and moved, the longer it will take to correctly position a person's fingers on the right levers in order to effect opening. Also, the apertures in the second element need not necessarily all be uniform and symmetrically spaced. It would be possible to have levers of a single configuration and an apertured plate 28 with offset apertures, and the placement of the apertures establishing whether a given lever will be normally locked or unlocked. Therefore, it should be understood that the invention should be measured only by the scope of the appended claims.

What is claimed is:

1. A locking apparatus having a locked mode in which it is closed and an unlocked mode in which it may be opened, and having an interior and an exterior, comprising:

a) first and second structural elements which are adapted to be juxtaposed and positioned next to one another in order to place the apparatus in its locked mode, and said structural elements being separable from one another when the apparatus is in its open mode, and the second structural element being mounted interiorly of the apparatus;

b) a plurality of levers mounted for rocking movement with respect to said first structural element, each of said levers having a first end which is configured so as to be manipulable by a person's fingers, and each of the levers having a second end which is sized and shaped so that it may be engaged with a lip surrounding an associated aperture in the second structural element, and the first and second structural elements being locked against separation when at least one of the lever second ends is engaged with the lip of an associated aperture;

c) means mounted on the first structural element for continuously biasing each of the levers to a rest position; and d) a plurality of apertures in the second structural element, including an aperture for each of the levers, and the apertures being aligned with respective ones of the levers on the first element, and at least one of the plurality of apertures being located such that the second end of one of the levers is normally in a locking position with respect to its associated aperture at the same time that all of the levers are biased to their rest positions, and each of the levers being temporarily movable in order to position the second end of each lever so that it will be disengaged from its associated aperture, whereby the locking apparatus will be in its open mode and the two structural elements may be separated whenever the levers are correctly positioned so that their second ends will not engage the lips of their associated apertures.

2. The locking apparatus as claimed in claim 1 wherein each of the levers is mounted for controlled movement in two co-planar directions.

3. The locking apparatus as claimed in claim 1 wherein each of the levers is movable into either of two distinct positions other than their respective rest positions.

4. The locking apparatus as claimed in claim 1 wherein the levers are mounted in a first pattern for rotational movement about a fulcrum rod, and the levers are selectively removable from said fulcrum rod and replaceable in a pattern that is different from their first pattern, whereby the combination of the locking apparatus may be changed by altering the manner in which the levers are mounted on the fulcrum rod.

5. The locking apparatus as claimed in claim 1 in which there are at least seven levers capable of moving to any one of two positions other than their respective rest positions, whereby there are at least 2187 possible combinations for selectively securing the locking apparatus in its locked mode.

6. The locking apparatus as claimed in claim 1 wherein each of the levers is capable of moving to two positions other than its rest position, and at least one of said three positions is a locked position that prevents separation of the two structural elements.

7. The locking apparatus as claimed in claim 1 wherein each of the levers is capable of moving to two alternate positions other than its rest position, and both of the alternate positions are locking positions in the sense that they constitute an interference condition between a part of a lever and a part of the second structural element.

8. The locking apparatus as claimed in claim 7 wherein the rest position for each lever is located on a straight line between the other two positions.

9. The locking apparatus as claimed in claim 7 wherein the rest position for each lever is centrally located between its other two positions.

10. The locking apparatus as claimed in claim 1 wherein some of the levers are shaped so that they will be biased to an unlocked mode when all of the levers are in their rest positions, and some of the levers are shaped so that they will be biased to their locked mode when all of the levers are in their rest positions, whereby it will be impossible to accidentally leave the locking apparatus in an unlocked condition, and whereby more than one lever must be moved to an unlocked position in order to separate the first and second structural elements.

11. The locking apparatus as claimed in claim 1 wherein the second ends of the levers are of two different configurations, and the location of the apertures in the second structural element is of a standard configuration, and wherein the particular combination of lever movements that will open a given locking apparatus is established by the unique arrangement of levers with respect to the apertures in the second structural element, whereby the number of different parts in a locking apparatus is minimized and the number of possible combinations is increased by choices in assembly rather than changes in part configuration.

12. The locking apparatus as claimed in claim 1 wherein the second ends of certain of the levers have a shape that is analogous to a single hook and others of the second ends have a shape that is analogous to a double hook, and each of the double hook portions constituting a mirror image of the other double hook portion.

13. The locking apparatus as claimed in claim 12 wherein each of the apertures in the second structural member is interrupted by a transverse bar, and wherein the transverse bar constitutes a structural extension of the lip that surrounds the aperture, and wherein those levers that have a double hook configuration are mounted on the first structural element in such a way that the two hooks normally rest on either side of the transverse bar.

14. The locking apparatus as claimed in claim 1 and further including a mechanical stop carried by the first structural element that serves as a limit of the amount of travel that each lever is permitted to have in a direction away from its rest position, whereby a person who is attempting to surreptitiously open the locking apparatus will feel contact with the mechanical stop as a lever is moved away from its rest position, and whereby the person will not be able to feel a change in the lever's resistance to movement as it is moved between an engaged and a disengaged position.

15. The locking apparatus as claimed in claim 1 wherein each of the levers has a fulcrum point and each of the fulcrum points is approximately midway between the lever's two ends.

16. The locking apparatus as claimed in claim 1 wherein the levers and the first and second structural members are stamped from steel sheet material.

17. The locking apparatus as claimed in claim 1 wherein the means for continuously biasing each of the levers to a rest position constitutes a resilient material having a Shore hardness of about 70 Durometer.

18. The locking apparatus as claimed in claim 1 wherein the means for biasing each of the levers to a rest position constitutes two blocks of resilient material, one of which is placed in front of and the other being placed behind the levers, and the blocks being sized to bear against the levers so as to resist any rocking motion by said levers.

19. The locking apparatus as claimed in claim 18 wherein the blocks of resilient material have a plurality of spaced slots that serve as side-to-side spacers for the plurality of levers.

20. The locking apparatus as claimed in claim 1 wherein the levers are arranged in two generally parallel rows.

21. The locking apparatus as claimed in claim 20 wherein the quantity of levers in one of the two rows is different than the quantity in the other row.

22. The locking apparatus as claimed in claim 1 wherein there are seven levers arranged in two parallel rows, with four levers being in one row and three levers being in the other row.

23. The locking apparatus as claimed in claim 1 wherein there are two types of levers, each of which has a different configuration on its second end, but the levers having identical configurations on their first ends, whereby a person cannot tell by looking at an exposed first end whether a given lever is of one type or the other.

24. A locking apparatus of the key-less type having a combination for opening the same, said combination being established by the correct movement of certain levers, comprising:

a) a first structural element having a fulcrum rod for supporting a plurality of levers so that the levers may rock forwardly and rearwardly with respect to the fulcrum rod;

b) a second structural element adapted to be engaged by the ends of certain levers, and said first and second structural elements being adapted to be juxtaposed and placed next to one another when the apparatus is locked;

c) a plurality of levers mounted on the fulcrum rod, and at least some of the levers being configured differently than other levers, and certain levers being configured in such a way that the locking apparatus is openable without moving said certain levers, and other levers being configured in such a way that they must be moved in order to render the locking apparatus openable; and d) means for biasing the levers to positions where at least one of the levers will render the locking apparatus locked when it is in its rest mode, such that the first and second structural elements cannot be separated until said at least one lever is moved to an unlocked position.

25. The locking apparatus as claimed in claim 24 wherein each lever has first and second ends, and the first ends are exposed where they may be manipulated a person's fingers and the second ends are concealed with the apparatus where they are adapted to engage the second structural member, and wherein the first ends of all of the levers are identically configured, whereby a person cannot tell from looking at a first end whether the lever is of one type or another.

* * * * *